US010709213B2

(12) United States Patent
Zeng et al.

(10) Patent No.: US 10,709,213 B2
(45) Date of Patent: Jul. 14, 2020

(54) WATCH LUG STRUCTURE

(71) Applicant: Anhui Huami Information Technology Co.,Ltd., Hefei, Anhui (CN)

(72) Inventors: Bo Zeng, Anhui (CN); Yi Zhang, Anhui (CN); Lian Zhang, Anhui (CN); Dingru Cao, Anhui (CN)

(73) Assignee: Anhui Huami Information Technology Co., Ltd., Hefei (CN)

( * ) Notice: Subject to any disclaimer, the term of this patent is extended or adjusted under 35 U.S.C. 154(b) by 261 days.

(21) Appl. No.: 15/993,634

(22) Filed: May 31, 2018

(65) Prior Publication Data

US 2018/0271231 A1 Sep. 27, 2018

Related U.S. Application Data

(63) Continuation of application No. PCT/CN2017/093908, filed on Jul. 21, 2017.

(30) Foreign Application Priority Data

Aug. 1, 2016 (CN) ..... 2016 2 0827944 U

(51) Int. Cl.

| | |
|---|---|
| ***A44C 5/14*** | (2006.01) |
| ***G04B 37/14*** | (2006.01) |
| ***G04B 37/00*** | (2006.01) |

(52) U.S. Cl.

CPC ..... *A44C 5/14* (2013.01); *A44C 5/147* (2013.01); *G04B 37/0008* (2013.01); *G04B 37/1486* (2013.01)

(58) Field of Classification Search

CPC ..... A44C 5/14; A44C 5/147; G04B 37/0008; G04B 37/1486; G04B 37/00; G04B 37/16

USPC ..... 368/282

See application file for complete search history.

(56) References Cited

U.S. PATENT DOCUMENTS

| | | | | |
|---|---|---|---|---|
| 2006/0162132 | A1* | 7/2006 | Roy | A44C 5/147 24/71 J |
| 2016/0037870 | A1* | 2/2016 | Perkins | A44C 5/14 24/664 |
| 2016/0069371 | A1* | 3/2016 | Chen | A44B 11/263 403/326 |
| 2019/0121295 | A1* | 4/2019 | Romano | G04B 37/1486 |

FOREIGN PATENT DOCUMENTS

| | | | |
|---|---|---|---|
| CN | 101082807 | A | 12/2007 |
| CN | 204044524 | U | 12/2014 |
| CN | 205038448 | U | 2/2016 |
| CN | 205193445 | U | 4/2016 |
| CN | 205958940 | U | 2/2017 |

OTHER PUBLICATIONS

International Search Report dated Oct. 10, 2017 in corresponding PCT Aplication No. PCT/CN2017/093908 with translation.

* cited by examiner

*Primary Examiner* — Edwin A. Leon

(74) *Attorney, Agent, or Firm* — Young Basile Hanlon & MacFarlane, P.C.

(57) ABSTRACT

A structure for a watch lug includes a watch case having a first positioning cavity and a second positioning cavity, a first watch lug inserted into the first positioning cavity, a second watch lug inserted into the second positioning cavity, and a coupling medium, wherein the first and second watch lugs are fixed to the watch case by the coupling medium.

13 Claims, 6 Drawing Sheets

WATCH LUG STRUCTURE

CROSS-REFERENCE TO RELATED APPLICATION(S)

This application is a continuation of International Application No. PCT/CN2017/093908, filed on Jul. 21, 2017, which claims priority to Chinese Patent Application No. 201620827944.0, filed on Aug. 1, 2016, the contents of both of which are hereby incorporated by reference in their entireties.

TECHNICAL FIELD

This disclosure relates to clocks or watches, in particular, to a structure for watch lugs.

BACKGROUND

Watch cases of ordinary or smartwatches can be made of plastics. A watch case can be installed to a watch lug using a standard strap. When the materials of the watch lug and the watch case are plastic and they are integrally manufactured and processed, due to limitations of plastic molding injection technology, an exterior surface of the plastic watch lug can have several parting lines that can be complicated to be removed and affect the appearance. The parting lines can be treated by grinding and spray painting, but it is uncomfortable for an individual to wear the spray-painted watch. Therefore, a watch lug structure that does not need spray painting and has appealing exterior is sought for.

SUMMARY

Disclosed herein is a structure for a watch lug. The structure includes a watch case having a first positioning cavity and a second positioning cavity, a first watch lug inserted into the first positioning cavity, a second watch lug inserted into the second positioning cavity, and a coupling medium, wherein the first and second watch lugs are fixed to the watch case by the coupling medium.

BRIEF DESCRIPTION OF THE DRAWINGS

This disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Herein, example implementations are described in detail and illustrated in accompanying drawings. When the following description refers to the accompanying drawings, unless otherwise indicated, the same numbers in different drawings represent the same or similar elements. The following example implementations described as follows do not represent all implementations consistent with this disclosure. Instead, they are only described as methods and apparatuses reflecting some or all of the aspects of this disclosure in accordance with the appended claims.

It should also be noted that, as used herein, the term "and/or" refers to and include any or all possible combinations of one or more listed related items.

In this disclosure, a watch case and its watch lugs can be independently machined. No parting line will be generated between the watch lugs and the watch case. The watch lugs can have a high-quality surface appearance. When the watch lugs are installed to the watch case as parts, the watch lugs can form an integral part with the watch case, increasing their aesthetic appearances. A coupling medium can be used to connect the watch lugs and the watch case, which can reduce the impact on the overall appearance of the watch.

Figure 1:
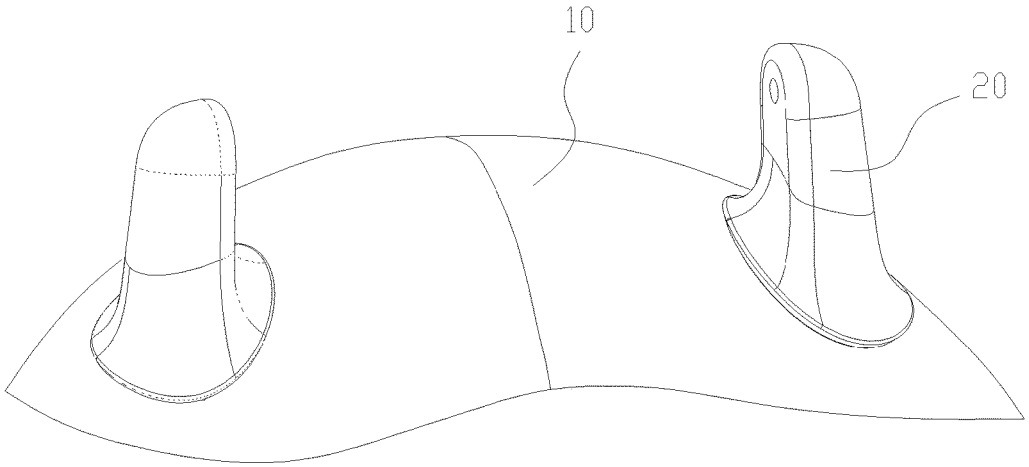
FIG. 1 is a diagram of an overall view of watch lugs installed to a watch case according to implementations of this disclosure.
Figure 3:
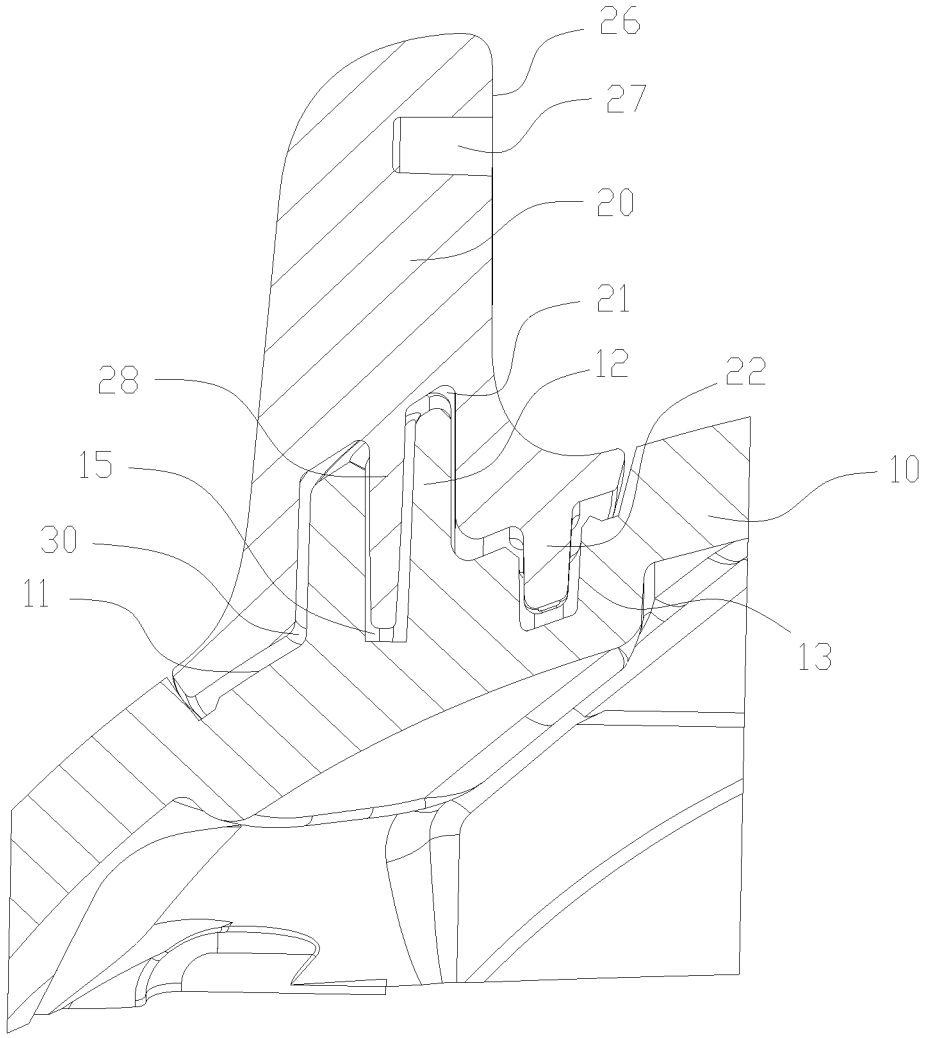
FIG. 3 is a diagram of a cross-sectional view of a structure for a watch lug installed to a watch case using an adhesive material according to implementations of this disclosure.

As shown in FIGS. 1 and 3, for example, a structure for a watch lug can include a watch case 10, one or more watch lugs (including a watch lug 20), and a coupling medium 30. The watch case 10 can be provided with one or more positioning cavities, including a positioning cavity 11. The watch lug 20 can be machined as a separate part. The structure of the watch lug 20 can be adapted to the positioning cavity 11. When the watch lug 20 is installed to the watch case 10, the watch lug 20 can be inserted into the positioning cavity 11 and fixed to the watch case 10 through the coupling medium 30. In some implementations, the coupling medium 30 can be disposed inside the watch case 10.

In this implementation, the watch case 10 can be used as a base member and be provided with the positioning cavity 11 that has functions of installation and positioning. The coupling medium 30 can be disposed in the positioning cavity 11. When the watch lugs are inserted into respective positioning cavities (e.g., when the watch lug 20 is inserted into the positioning cavity 11), the watch lug 20 can be fixed to the watch case 10 using the coupling medium 30, in which the watch lug 20 and the watch case 10 can form an integral entity. For example, in the production of smartwatches, watch lugs (e.g., the watch lug 20) can be machined as independent parts so that no parting line can be formed between the watch lug 20 and the watch case 10. By doing so, the watch lug 20 can have a high-quality surface appearance and easy installation, and the overall quality of the smartwatches can be easier to control. Further, the coupling medium 30 can be disposed inside the watch case 10, which does not affect the appearance of the smartwatch. The materials of the watch case 10 and the watch lug 20 can be the same or different. For example, the materials of the watch case 10 and the watch lug 20 can be plastic. For another example, one of the materials can be plastic and the other one can be metal. For another example, both the materials can use other materials. According to implementations of this disclosure, the materials for the watch lug 20 can be flexibly selected to facilitate machining.

In some implementations, to accurately positioning and fixing the watch lug 20 on the watch case 10, the watch lug 20 and the watch case 10 can be connected using an adhesive material or a fastener 31.

Figure 2:
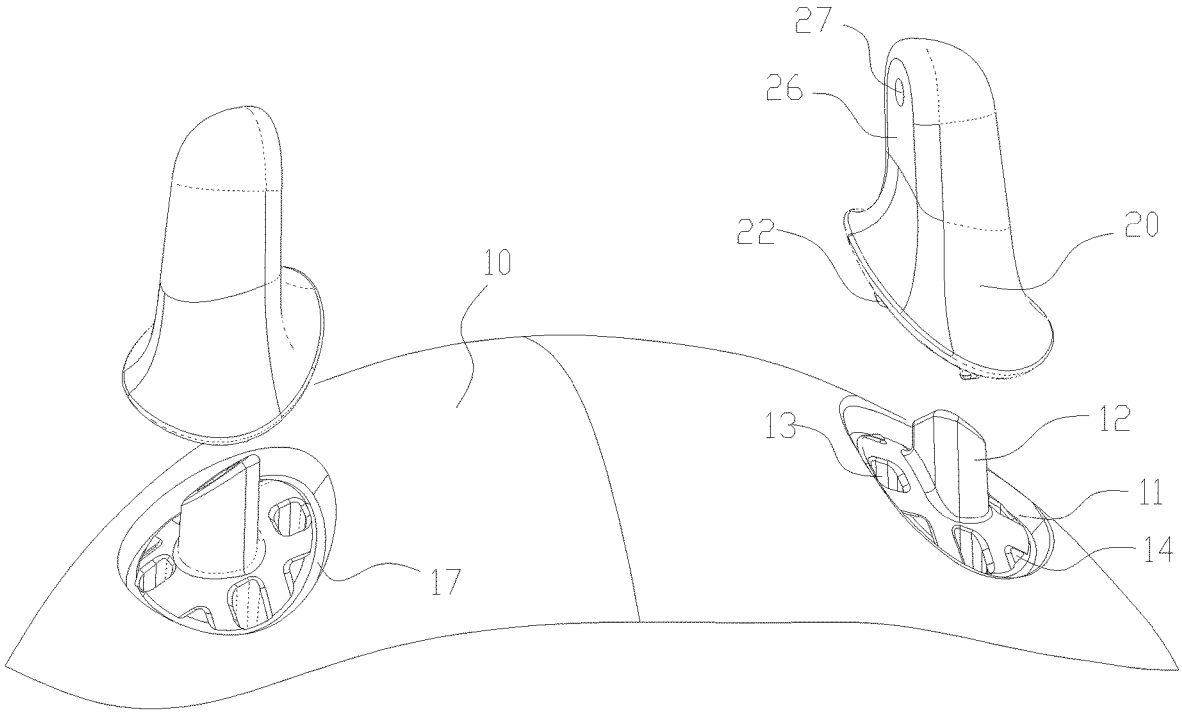
FIG. 2 is a diagram of an exploded view of structures of watch lugs installed to a watch case using an adhesive material according to implementations of this disclosure.

First configuration using an adhesive material as the coupling medium 30:

As shown in FIGS. 2 and 3, the adhesive material can be coated on a contacting surface of the watch case 10 and/or the watch lug 20. For example, the adhesive material can be applied to the positioning cavity 11 of the watch case 10. For another example, the adhesive material can be applied to the contacting surface between the watch lug 20 and the watch case 10. For another example, the adhesive material can be applied to the positioning cavity 11 and the watch lug 20. It should be noted that other combinations of coating the adhesive material are possible. By using the adhesive material to connect the watch lug 20 and the watch case 10, the connection between the watch lug 20 and the watch case 10 can be strong. In some implementations, a bottom surface and a wall of the positioning cavity 11 can form a closed surface. In some implementations, the intersection of the bottom surface and the wall of the positioning cavity 11 can be provided with a groove 17 (e.g., a circumferential groove or a ring-shaped groove). For example, the groove 17 can sink or recess downward from the bottom surface of the positioning cavity 11. By using the groove 17, the contacting surface area between the wall of the positioning cavity 11 and the watch lug 20 can be increased to tighten the connection between them. Also, a space for gluing can be reserved for the adhesive material, which can improve bonding strength to tighten the connection between the watch lug 20 and the watch case 10. The positioning cavity 11 provided on the watch case 10 can be of a closed design, in which the watch can be air-tight and waterproof.

A positioning post 12 can be provided in the positioning cavity 11. The positioning post 12 can protrude from an outer surface of the watch case 10. The watch lug 20 can be provided with an installation hole 21. When the watch lug 20 is inserted into the positioning cavity 11, the positioning post 12 can be inserted into the assembling hole 21. The positioning post 12 can assist guiding and positioning the watch lug 20 to make the installation position of the watch lug 20 accurate. A bottom surface of the installation hole 21 can be arranged as a slanted or inclined surface (e.g., a slope). The inclined surface of the installation hole 21 can be used to adjust, during production, an amount of deformation of the shape and size of the watch lug 20 for ensuring the accuracy of the appearance and dimensions of the watch lug 20. An end surface of the positioning post 12 can be arranged as an inclined surface matching the bottom surface of the installation hole 21.

A guide hole 15 can be provided inside the positioning post 12. For example, the guide hole 15 can be a counterbore or a countersink. A guide post 28 can be provided inside the installation holes 21. The guide post 28 can stick or protrude into the installation hole 21. In some implementations, the guide post 28 can be arranged in a regular geometric shape, such as a frustum, a cuboid, or a cylinder. The guide post 28 can also be arranged in an irregular geometric shape, such as a shape tapering along the protruding direction with an even surface. The outer surface of the guide post 28 can be provided with a cut surface. When the watch lug 20 is inserted into the positioning cavity 11, the guide post 28 can be inserted into the guide hole 15 to guide the assembly of the positioning post 12 and the installation hole 21. The guide post 28 can be used to improve the installation accuracy of the watch lug 20 and reduce displacement deviation of the watch lug 20 after it is installed. The guide post 28 can also be used to increase the glued area between the watch lug 20 and the watch case 10.

Figure 4:
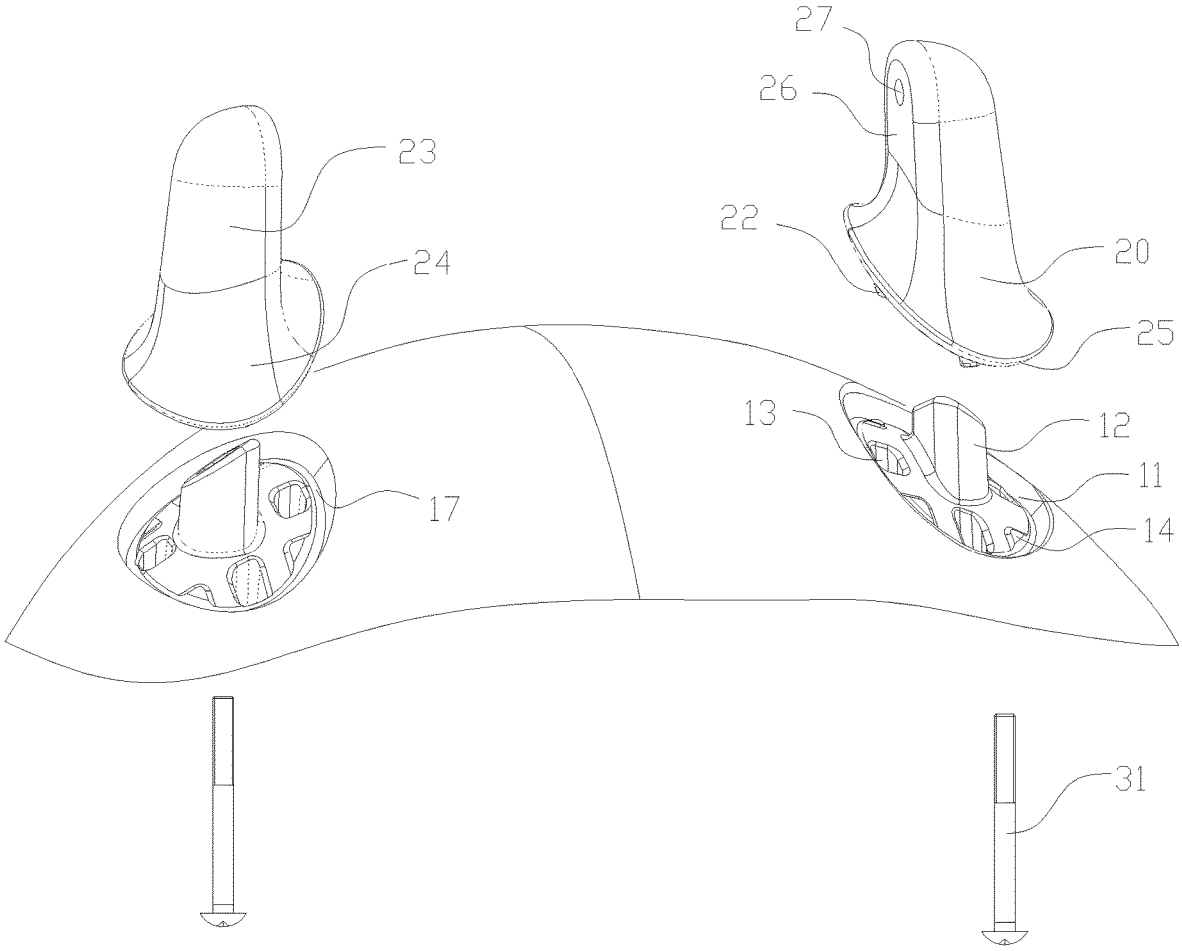
FIG. 4 is a diagram of an exploded view of structures of watch lugs installed to a watch case using a fastener according to implementations of this disclosure.
Figure 5:
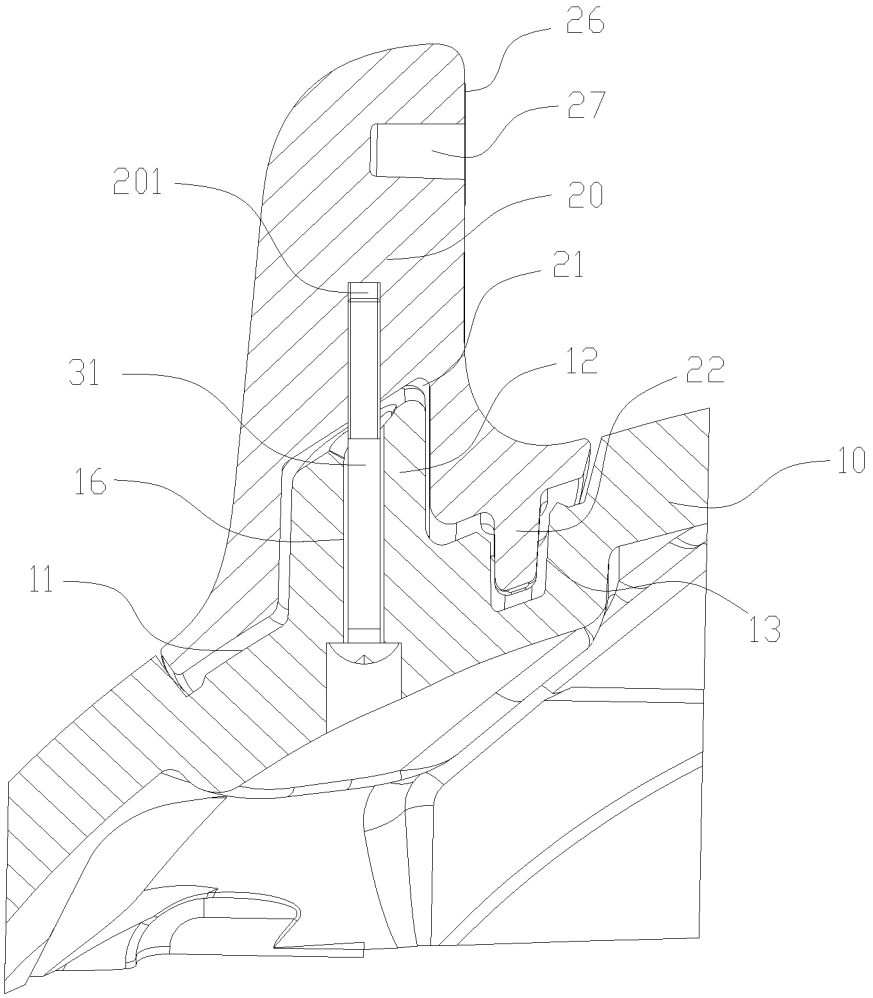
FIG. 5 is a diagram of a cross-sectional view of a structure for a watch lug installed to a watch case using a fastener according to implementations of this disclosure.

Second configuration using the fastener 31 as the coupling medium 30:

As shown in FIGS. 4 and 5, for example, the watch case 10 can be provided with a through hole 16. In some implementations, the through hole 16 can pierce or penetrate through the bottom surface of the positioning cavity 11. In some implementations, the watch lug 20 can be provided with a connection hole 201. For example, the connection hole 201 can be opened along a center line of the through hole 16. The fastener 31 can penetrate through the through hole 16 from the inside of the watch case 10. The fastener 31 can be locked to the connection hole 201 for fixing the watch lug 20 to the watch case 10. In some implementations, the fastener 31 can penetrate from the inside of the watch case 10 to the outside of the watch case 10 to fix the watch lug 20. By doing so, the watch lug 20 can be easy to be installed and fixed, and the outer surface of the watch lug 20 can be kept smooth and even, which can facilitate mold machining.

The positioning post 12 can be provided inside the positioning cavity 11. For example, the positioning cavity 11 can be a counterbore or a countersink. An end of the positioning post 12 can protrude from the surface of the watch case 10. The through hole 16 can pierce or penetrate through the positioning post 12. For example, the axis of the through hole 16 can be parallel to the centerline of the positioning post 12. The watch lug 20 can be provided with an installation hole 21. The connection hole 201 can be arranged inside the installation hole 21. When the watch lug 20 is inserted into the positioning cavity 11, the positioning post 12 can be inserted into the installation hole 21, and the fastener 31 can penetrate through the through hole 16 to lock the watch lug 20 onto the watch case 10. In some implementations, the through hole 16 can be arranged along the protruding direction of the positioning post 12, linking the inner surface and the outer surface of the watch case 10. The installation hole 21 of the watch lug 20 can be matched with the positioning post 12. For example, the axis of the through hole 16 can be collinear with the axis of the connection hole 201. The fastener 31 can penetrate through the through hole 16 to connect the watch lug 20 and the watch case 10. The positioning post 12 can be oriented to reduce displacement deviation of the installation position of the watch lug 20 and increase its installation accuracy.

Figure 6:
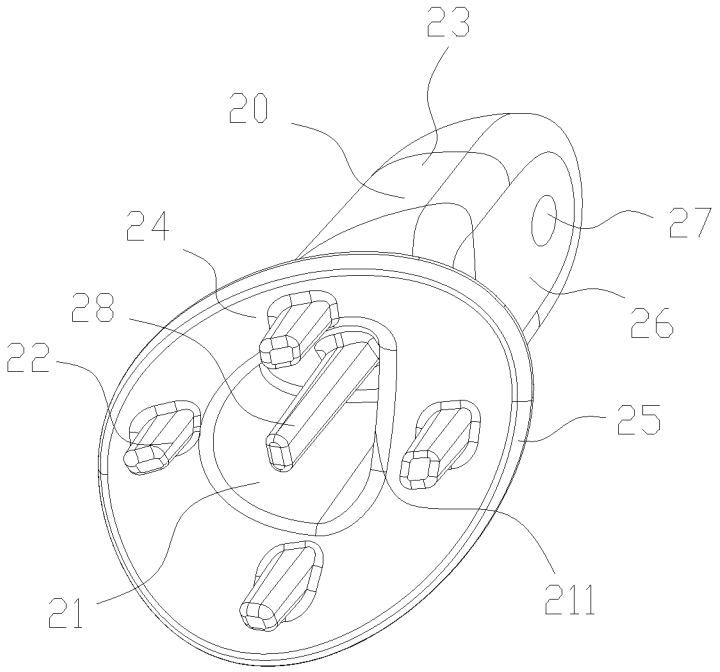
FIG. 6 is a diagram of a structure for a watch lug according to implementations of this disclosure.
Figure 7:
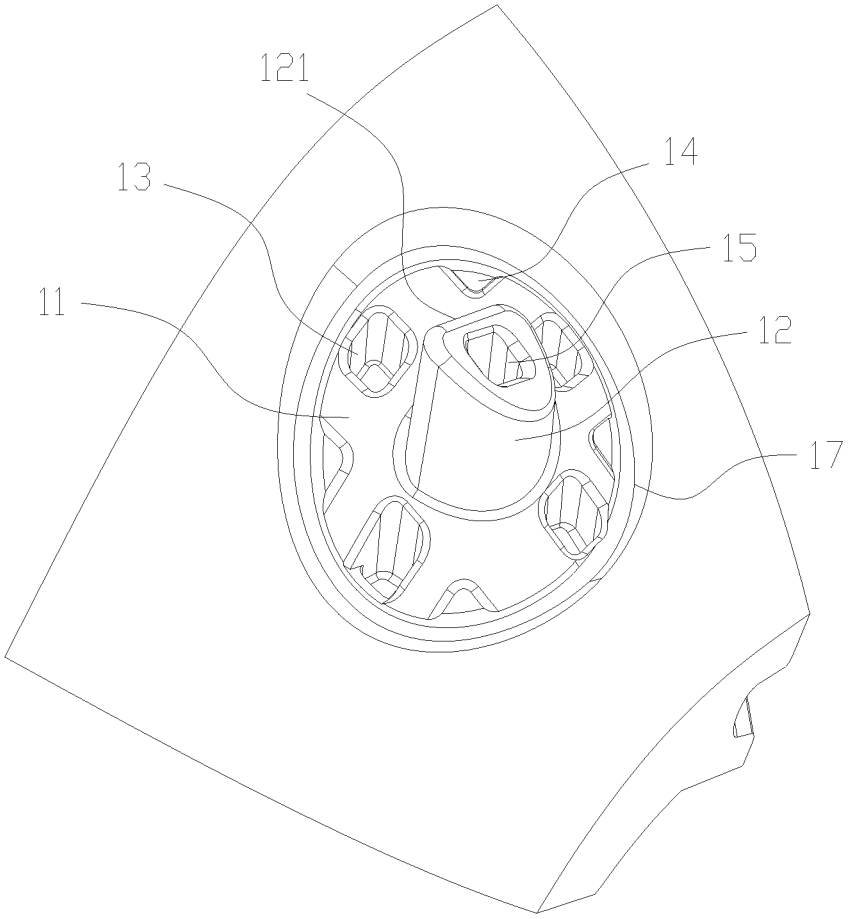
FIG. 7 is a diagram of an enlarged view of a positioning cavity of a watch case according to implementations of this disclosure.

As shown in FIGS. 6 and 7, in the first and second configurations that respectively uses the adhesive material or the fastener 31 as the coupling medium 30, the positioning post 12 can be provided with a positioning surface 121. For example, the positioning surface 121 can be arranged on the outer surface of the positioning post 12 and parallel to the axis of the positioning post 12. The installation hole 21 can be provided with a mating surface 211. The mating surface 211 can be matched with the positioning surface 121. When the watch lug 20 is inserted into the positioning cavity 11, the positioning surface 121 and the mating surface 211 can limit each other. For example, the positioning post 12 and the installation hole 21 can be matched using a tight fit manner, which can make the mating surface 211 and the positioning surface 121 press against each other. For another example, the positioning post 12 and the installation hole 21 can be matched using a clearance fit manner, such as setting a space for gluing between the positioning post 12 and the installation hole 21. The mating surface 211 and the positioning surface 121 can be used to guide and limit a rotation of the watch lug 20.

In some implementations, one or more limiting holes can be provided in the positioning cavity 11, including a limiting hole 13. For example, the limiting hole 13 can be recessed downward from the bottom surface of the positioning cavity 11. Accordingly, one or more limiting posts (including a limiting post 22) can be provided on the bottom surface of the watch lug 20. The limiting post 22 can protrude from the bottom surface of the watch lug 20. When the watch lug 20 is inserted into the positioning cavity 11, the limiting post 22 can be inserted into the limiting hole 13. The limiting post 22 can be arranged corresponding to the limiting hole 13. The limiting post 22 can assist positioning the installation location of the watch lug 20 independently or in coordination with the positioning post 12 for reducing displacement of the installation location of the watch lug 20.

In the configuration that the adhesive material is used as the coupling medium 30, when the limiting post 22 and limiting hole 13 are matched using a tight fit, the limiting post 22 can be used to guide and position the installation of the watch lug 20. When the limiting post 22 and limiting hole 13 is matched using a clearance fit, the limiting post 22 can be used to increase the glue area between the watch lug 20 and the watch case 10 to increase the bonding strength.

In the configuration that the fastener 31 is used as the coupling medium 30, when the limiting post 22 and limiting hole 13 is matched using the tight fit or the clearance fit, the limiting post 22 can be used to guide and position the installation of the watch lug 20, which can limit a rotation of the watch lug 20 and increase stability of the installation of the watch lug 20.

As shown in FIGS. 2, 4, 6, and 7, for example, the wall of the positioning cavity 11 can be made of a shape similar to a tapered surface. For example, the slope of the wall can decrease along a direction upward from a bottom surface of the positioning cavity 11. The watch lug 20 can be provided with an installation surface 25. When the watch lug 20 is inserted into the positioning cavity 11, the installation surface 25 can be matched with the positioning cavity 11. In some implementations, two watch lugs can be arranged opposite (e.g., directly opposite) to each other on the watch case 10, and the two watch lugs can be parallel to each other. For example, a first slope of the wall of the positioning cavity 11 in a direction toward the watch lug 20 can be small, and a second slope of the wall of the positioning cavity 11 in a direction away from the watch lug 20 can be large (e.g., larger than the first slope). By varying the slope of the wall, the watch lugs can fit more tightly to the watch case 10, and the watch lugs can be more parallel to each other.

As shown in FIGS. 2, 4, and 6, for example, the watch lug 20 can include a connecting portion 24 and a protruding portion 23. The cross-sectional area of the connecting portion 24 is larger than the cross-sectional area of the protruding portion 23. The connecting portion 24 and the protruding portion 23 can form a trumpet-like profile. The protruding portion 23 can be arranged atop the connecting portion 24 in an inclined manner, and the protruding portion 23 and the connecting portion 24 can be connected through a transitional curved surface. The protruding portion 23 can be provided with a connecting surface 26. The connecting surface 26 can be provided with a bolt hole 27. For example, two watch lugs can be installed on the watch case 10, in which the connecting surfaces of the two watch lugs can be opposite (e.g., directly opposite) to each other, and the axes of the bolt holes of the two watch lugs can be collinear. A standard watch strap can be installed at the bolt holes of the two watch lugs through a telescopic bar or a spring bar. The installation surfaces of the watch lugs can be bonded to the wall of the positioning cavity 11, and the positions of their positioning posts and the installation holes can be matched, by which the parallel between the connecting surfaces of the two watch lugs and the collinearity between the bolt holes of the two watch lugs can be adjusted to improve accuracy of the installation location of the spring bar and increase flexibility of rotating the watch strap.

In some implementations, the installation surface 25 can be provided on an end surface of the connecting portion 24. For example, the installation surface 25 and the protruding portion 23 can be arranged at two ends of the connecting portion 24. Due to the large cross-sectional area of the connecting portion 24, the contacting surface between the installation surface 25 and the positioning cavity 11 can also be large, by which the bonding strength between the installation surface 25 and the positioning cavity 11 can be increased.

As shown in FIGS. 2 and 4, in some implementations, one or more bosses (including a boss 14) can be provided on the bottom surface of the positioning projection 11. The boss 14 can be spaced between several limiting holes. The boss 14 can be used adjust a space between the watch lug 20 and the bottom surface of the positioning cavity 11 to facilitate the coagulation of the adhesive material and increase capacity and thickness of the adhesive material. Also, the boss 14 can be used to adjust the contacting surface between the watch lug 20 and the watch case 10, by which the installation surface 20 can be glued tightly to the wall of the positioning cavity 11, the stability of the installation of the watch lug 20 can be increased, and the spacing between the watch lug 20 and the watch case 10 can be reduced.

It should be noted that the aforementioned implementations are only examples of this disclosure, not intended to limit this disclosure. Within the spirits and principles of this disclosure, any modification, equivalent replacement, or improvement should fall within the protection scope of this disclosure.

What is claimed is:

1. A structure for a watch lug, comprising:

a watch case having a first positioning cavity and a second positioning cavity;

a first watch lug inserted into the first positioning cavity;

a second watch lug inserted into the second positioning cavity; and a coupling medium, wherein the first and second watch lugs are fixed to the watch case by the coupling medium, wherein the first positioning cavity is provided with at least one limiting hole, wherein the at least one limiting hole is recessed downward from a bottom surface of the first positioning cavity, wherein the first watch lug is provided with at least one limiting post protruding from the first watch lug, and wherein when the first watch lug is inserted into the first positioning cavity, the at least one limiting post is inserted into the at least one limiting hole in a corresponding manner.

2. The structure of claim 1, wherein the first positioning cavity is provided with a positioning post, the first watch lug is provided with an installation hole, and when the first watch lug is inserted into the first positioning cavity, the positioning post is inserted into the installation hole.

3. The structure of claim 2, wherein an outer surface of the positioning post is provided with a positioning surface parallel with an axis of the positioning post;

the installation hole is provided with a mating surface; and when the first watch lug is inserted into the first positioning cavity, the positioning surface and the mating surface limit each other.

4. The structure of claim 2, wherein the coupling medium comprises an adhesive material; and the adhesive material is coated on a contacting surface of the watch case and the first watch lug.

5. The structure of claim 4, wherein the positioning post is provided with a guide hole inside the positioning post;

the installation hole is provided with a guide post protruding into the installation hole; and when the first watch lug is inserted into the first positioning cavity, the guide post is inserted into the guide hole.

6. The structure of claim 2, wherein the coupling medium comprises a fastener;

the watch case is provided with a through hole;

the first watch lug is provided with a connection hole, wherein an axis of the connection hole is collinear with an axis of the through hole; and the fastener penetrates through the through hole and locks to the connection hole.

7. The structure of claim 6, wherein the through hole penetrates the positioning post;

the connection hole is provided inside the installation hole; and when the first watch lug is inserted into the first positioning cavity, the positioning post is inserted into the installation hole, and the fastener locks to the connection hole.

8. The structure of claim 1, wherein a bottom surface of the first positioning cavity and a wall of the first positioning cavity form a closed surface.

9. The structure of claim 1, wherein a circumferential groove is provided at an intersection of a bottom surface of the first positioning cavity and a wall of the first positioning cavity; and the circumferential groove is recessed downward from the bottom surface of the first positioning cavity.

10. The structure of claim 1, wherein each of the first and second watch lugs further comprises:

a connecting portion; and a protruding portion connected to the connecting portion through a transitional curved surface, wherein the protruding portion is provided with a connecting surface having a bolt hole, and when the first watch lug and the second watch lug are installed on the watch case, the connecting surface of the first watch lug is directly opposite to the connecting surface of the second watch lug, and an axis of the bolt hole of the first watch lug is collinear with an axis of the bolt hole of the second watch lug.

11. The structure of claim 10, wherein the connecting portion of the first watch lug is provided with an installation surface;

the protruding portion of the first watch lug and the installation surface are situated on two respective ends of the connecting portion of the first watch lug; and when the first watch lug is inserted into the first positioning cavity, the installation surface is matched with a wall of the first positioning cavity.

12. The structure of claim 11, wherein the wall of the first positioning cavity is a tapered surface, and a slope of the wall decreases along a direction upward from a bottom surface of the first positioning cavity.

13. The structure of claim 1, wherein a bottom surface of the first positioning cavity is provided with at least one boss raised from the bottom surface.

* * * * *